US010053929B2

(12) United States Patent
Spears et al.

(10) Patent No.: US 10,053,929 B2
(45) Date of Patent: Aug. 21, 2018

(54) EXTENSION MEMBERS FOR SUBSEA RISER STRESS JOINTS

(71) Applicant: OIL STATES INDUSTRIES, INC., Arlington, TX (US)

(72) Inventors: Christopher Spears, Naperville, IL (US); Pierre Albert Beynet, Naperville, IL (US)

(73) Assignee: OIL STATES INDUSTRIES, INC., Arlington, TX (US)

( * ) Notice: Subject to any disclaimer, the term of this patent is extended or adjusted under 35 U.S.C. 154(b) by 0 days.

(21) Appl. No.: 15/616,383

(22) Filed: Jun. 7, 2017

(65) Prior Publication Data

US 2017/0356255 A1 Dec. 14, 2017

Related U.S. Application Data

(60) Provisional application No. 62/347,663, filed on Jun. 9, 2016.

(51) Int. Cl.

| | |
|---|---|
| ***E21B 15/02*** | (2006.01) |
| ***E21B 17/01*** | (2006.01) |
| ***E21B 17/02*** | (2006.01) |
| ***E21B 43/01*** | (2006.01) |
| ***E21B 7/12*** | (2006.01) |
| ***E02D 5/74*** | (2006.01) |
| ***F16B 21/00*** | (2006.01) |
| ***E21B 19/00*** | (2006.01) |

(52) U.S. Cl.

CPC ..... *E21B 19/004* (2013.01); *E21B 15/02* (2013.01); *E21B 17/017* (2013.01)

(58) Field of Classification Search

None

See application file for complete search history.

(56) References Cited

U.S. PATENT DOCUMENTS

| | | | |
|---|---|---|---|
| 4,097,069 | A | 6/1978 | Morrill |
| 4,469,181 | A | 9/1984 | Kellett |
| 5,474,132 | A | 12/1995 | Gallagher |
| 5,947,642 | A | 9/1999 | Teixeira et al. |

(Continued)

OTHER PUBLICATIONS

PCT; International Search Report and Written Opinion; PCT/US17/36382, dated Jun. 7, 2017.

*Primary Examiner* — Matthew R Buck
*Assistant Examiner* — Douglas S Wood
(74) *Attorney, Agent, or Firm* — Morgan, Lewis & Bockius LLP

(57) ABSTRACT

An extension member for coupling a tapered stress joint to a basket coupled to a porch extending from an offshore platform is disclosed. In an embodiment, the extension member includes a central axis, a first end, and a second end opposite the first end. In addition, the extension member includes a radially inner surface extending axially from the first end to the second end. The inner surface includes a first mating profile proximate the first end that is configured to engage a radially outer surface of the tapered stress joint. Further, the extension member includes a radially outer surface extending axially from the first end to the second end. The outer surface includes a second mating profile proximate the second end that is configured to slidingly engage a mating profile within the basket.

30 Claims, 10 Drawing Sheets

(56) References Cited

U.S. PATENT DOCUMENTS

| | | | | |
|---|---|---|---|---|
| 8,474,539 | B2 * | 7/2013 | Luo | E21B 19/004 166/341 |
| 2003/0019625 | A1 | 1/2003 | Moog | |
| 2003/0089075 | A1 | 5/2003 | Oram | |
| 2005/0224123 | A1 | 10/2005 | Baynham | |
| 2007/0261226 | A1 | 11/2007 | Deul | |
| 2009/0129853 | A1 | 5/2009 | Pionetti | |
| 2011/0280668 | A1 | 11/2011 | Norwood | |
| 2013/0195558 | A1 | 8/2013 | Storksen | |

* cited by examiner

EXTENSION MEMBERS FOR SUBSEA RISER STRESS JOINTS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Embodiments disclosed herein generally relate to offshore oil and gas production operations. More particularly, embodiments disclosed herein relate to systems and methods for coupling risers to floating offshore production vessels.

During offshore oil and gas production operations, risers are coupled to a floating offshore platform (e.g., semi-submersible platform) and extend subsea to a production fluid source disposed at or proximal the sea floor (e.g., a subsea well, a manifold, a subsea pipeline, etc.). In some circumstances, particularly in deep water applications, the weight of the riser results in a significant amount of tension in the upper section of the riser disposed above the surface of the water and coupled to the platform. For steel catenary risers (SCRs), such tension can induce significant bending moments at the connection point(s) between the riser and offshore platform. Movement of the floating platform in response to dynamic loads (e.g., movements caused by wind, waves, and other phenomena) can cause additional tension and bending in the riser which is borne at these connection point(s).

BRIEF SUMMARY OF THE DISCLOSURE

Some embodiments disclosed herein are directed to an extension member for coupling a tapered stress joint to a basket coupled to a porch extending from an offshore platform. In an embodiment, the extension member includes a central axis, a first end, and a second end opposite the first end. In addition, the extension member includes a radially inner surface extending axially from the first end to the second end. The inner surface comprises a first mating profile proximate the first end that is configured to engage a radially outer surface of the tapered stress joint. Further, the extension member includes a radially outer surface extending axially from the first end to the second end. The outer surface comprises a second mating profile proximate the second end that is configured to engage a mating profile within the basket.

Other embodiments are directed to a system for supporting a riser from an offshore platform. In an embodiment, the system includes a basket configured to be coupled to the offshore platform. In addition, the system includes a tapered stress joint coupled to the riser. The tapered stress joint includes a central axis, a first end, a second end opposite the first end, and a radially outer surface that tapers radially inward from the first end toward the second end. Further, the system includes an extension member coupled to each of the basket and the tapered stress joint. The extension member includes a first end and a second end opposite the first end. The extension member is coupled to the tapered stress joint proximate the first end of the extension member. The extension member is coupled to the basket proximate the second end of the extension member.

Still other embodiments are directed to a system for supporting a riser from an offshore platform. In an embodiment, the system includes a connection assembly coupled to the offshore platform. In addition, the system includes a tapered stress joint coupled to the riser. Further, the system includes an extension member coupled to each of the connection assembly and tapered stress joint. The extension member is a hollow tubular member that includes a central axis, a first end, and a second end opposite the first end. In addition, the extension member includes a radially inner surface extending axially between the first end and the second end. Further, the extension member includes a radially outer surface extending axially between the first end and the second end. The extension member is coupled to the connection assembly along the radially outer surface proximate the second end. The extension member is coupled to the tapered stress joint along the radially inner surface proximate the first end.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF EXEMPLARY EMBODIMENTS

Figure 1:
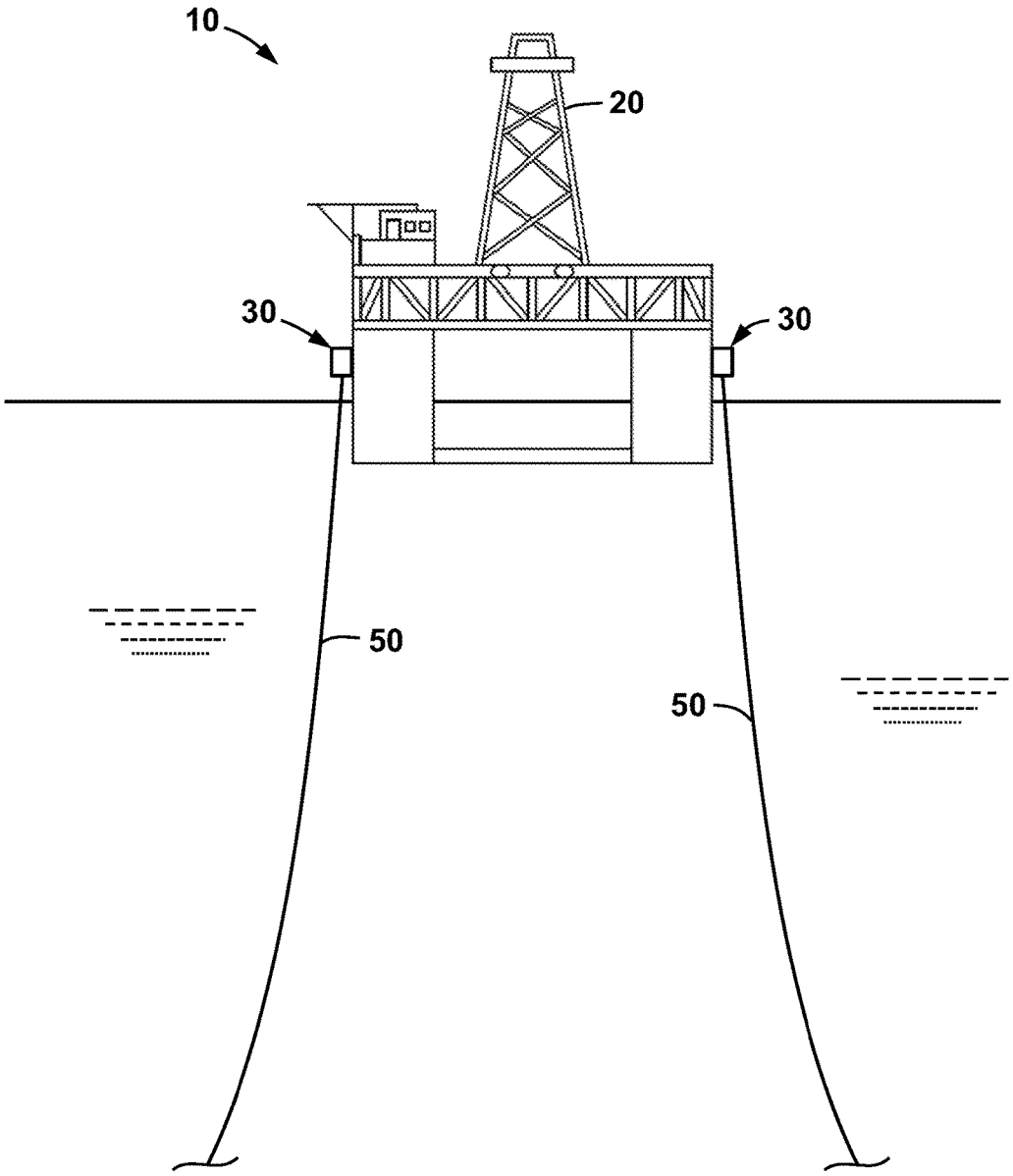
FIG. 1 is a schematic front view of an offshore production system.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As previously described, the weight of a riser induces tension in the riser and dynamic movement of the offshore platform to which the riser is coupled (e.g., due to weather, waves or other phenomena) induces bending moments that are borne by the connection point(s) between the platform and the riser. If the bending moments become sufficiently large, they can lead to undesirable fatigue and/or failure at the connection between the riser and platform. Conventionally, the induced bending moments are accommodated by an elastomeric flex joint that allows limited pivoting of the riser relative to the offshore platform. However, as production fluid conditions (e.g., temperature, pressure, etc.) become more extreme, the use of elastomeric flex joints is less feasible. In particular, contact with higher temperature fluids and/or higher pressure fluids weaken the elastomers making up the flex joint, thereby leading the possibility of a leak or other failure. All metal tapered stress joints offer an alternative to elastomeric flex joints, and exhibit increased resistance to the above described harsh operating conditions. However, tapered stress joints are significantly more rigid then elastomeric flex joints, and as a result, tend to transfer much higher bending moments to the support structure on the offshore platform (e.g., the porch and basket). In some cases, a tapered stress joint can transfer a moment that is between four times (4×) and thirty times (30×) greater than the moment transferred by an elastomeric flex joint for a similar tension load on the riser. Most offshore platforms do not include sufficient structures to withstand the high bending moments associated with tapered stress joints. Thus, embodiments disclosed herein include structures for coupling a tapered stress joint to a floating offshore platform that offer the potential to reduce the magnitude of the bending moments experienced at the connection point between the tapered stress joint and the offshore platform during production operations. Accordingly, embodiments described herein can be retrofit for use in connection with existing offshore platforms in place of the more traditional elastomeric flex joint.

Referring now to FIG. 1, a system 10 for producing hydrocarbons from a subsea production site (e.g., a well, manifold, etc.) is shown. System 10 generally includes a floating offshore platform 20 and plurality of risers 50 coupled to platform 20 with connection assemblies 30. As shown in FIG. 1, platform 20 is a semi-submersible platform. Risers 50 extend downward from platform 20 to a production fluid source site (not shown) proximal or at the sea floor. In FIG. 1, the risers 50 are steel catenary risers (SCRs), and thus, risers 50 take on a curved shape between platform 20 and the sea floor (not shown). Each riser 50 is coupled to platform 20 with a connection assembly 30. As a result, movements and loads (e.g., tension, torque, etc.) experienced by risers 50 are transferred to platform 20 through the corresponding connection assemblies 30. Conversely, movements and loads experienced by platform 20 are transferred through connection assemblies 30 to risers 50. In general, risers 50 transfer production fluids from the subsea source to platform 20. Thus, during production operations, production fluids are routed from the subsea production site to platform 20 through risers 50.

Figure 2:
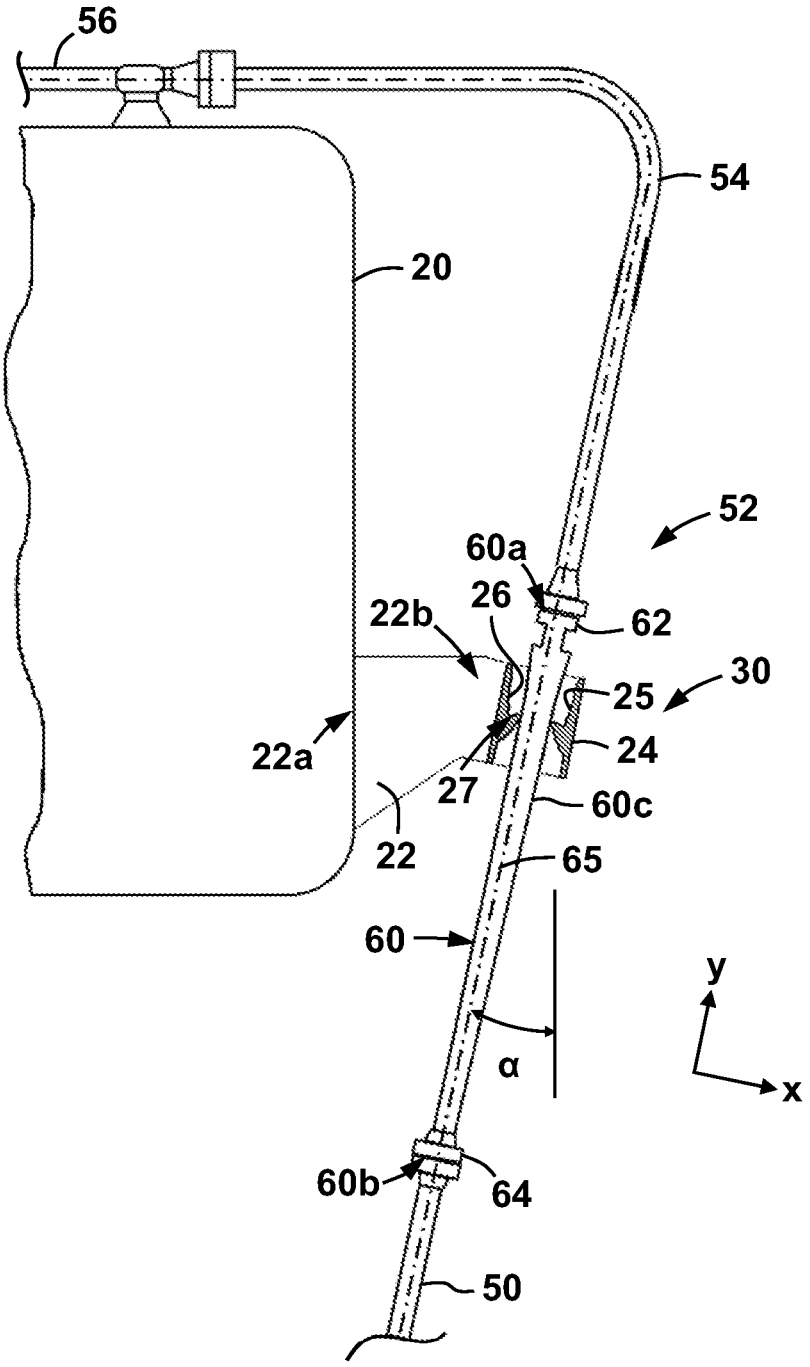
FIG. 2 is a side, partial cross-sectional view of one of the riser connection assemblies for connecting an upper riser assembly of one subsea riser of FIG. 1 to the offshore platform of FIG. 1.

Referring now to FIG. 2, one connection assembly 30 for coupling one riser 50 to platform 20 is shown. In general, connection assembly 30 includes a porch 22 secured to platform 20, a basket 24 attached to porch 22 distal platform 20, and an upper riser assembly 52. Porch 22 includes a first or proximal end 22*a* directly connected to platform 20 and a second or distal end 22*b* attached to basket 24. Basket 24 is a tubular sleeve having an inner surface 25 including a profile 26 that receives, mates with, and slidingly engages the outer riser stress joint 60 of upper riser assembly 52.

Referring still to FIG. 2, upper riser assembly 52 includes a spool 54 and tapered stress joint 60. Tapered stress joint 60 includes a central axis 65, a first or upper end 60*a*, a second or lower end 60*b* opposite upper end 60*a*, and a radially outer surface 60*c* extending between ends 60*a*, 60*b*. Upper end 60*a* of stress joint 60 is coupled to spool 54 with a first or upper connection flange 62 and lower end 60*b* of stress joint 60 is coupled to riser 50 with a second or lower connection flange 64. Spool 54 extends from upper end 60*a* of stress joint 60 to additional piping 56 on platform 20. In general, spool 54 may comprise any suitable conduit (e.g., pipe, tube, hose, line, etc.) that is capable of receiving and routing fluids flowing through riser 50 to piping 56 on platform 20. For example, spool 54 may comprise a rigid conduit (e.g., metallic pipe) or may comprise a flexible conduit that may be easily bent or deformed as needed.

Stress joint 60 is generally frustoconical in shape, and thus, radially outer surface 60*c* tapers radially inward moving axially from upper end 60*a* toward lower end 60*b*. In other words, the outer diameter of stress joint 60 decreases moving from upper end 60*a* to lower end 60*b*. As a result, stress joint 60 has an increasing degree of flexibility moving axially from upper end 60*a* toward lower end 60*b*. During operations, stress joint 60 is inserted within basket 24 such that radially outer surface 60*c* slidingly engages profile 26, thereby coupling stress joint 60 and riser 50 to platform 20. In this embodiment, stress joint 60 is secured within basket 24 via a friction fit between radially outer surface 60*c* and a shoulder 27 defined profile 26; however, any other suitable engagement may be used. In addition, in this embodiment, basket 24 of connection assembly 30 is oriented such that when stress joint 60 is inserted axially therein, the central axis 65 of joint 60 forms an angle α with the vertical direction. As shown in FIG. 2, angle α is 12°.

Figure 3:
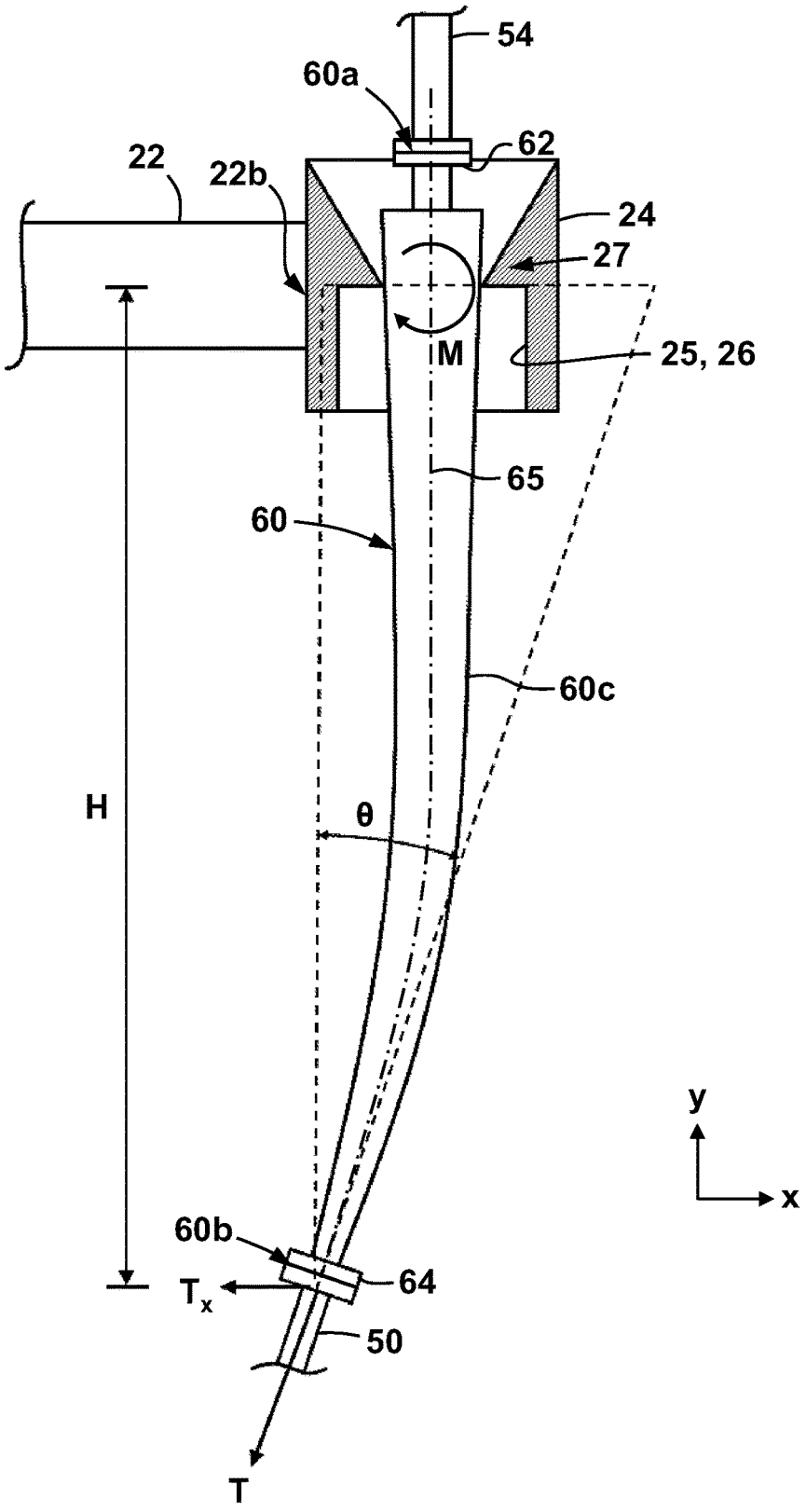
FIG. 3 is a schematic free body diagram of the riser connection assembly and the upper riser assembly of FIG. 2 illustrating the bending moment resulting from tension in the riser.

Referring now to FIG. 3, during operations, the weight of riser 50 and movements of the platform 20 relative to the sea floor, such as those caused by waves, currents, and/or other phenomena, result in a tension in riser 50 and bending in the stress joint 60. In particular, a tension T is applied along the riser 50 that pulls laterally on stress joint 60, and thereby causes central axis 65 of stress joint 60 to bend or curve at angle θ relative to the y-direction shown in FIG. 3 (note: the y-direction is parallel to the central axis 65 when stress joint 60 is not bent or curved such as shown in FIG. 2). Thus, the tension T induces a bending moment M in stress joint 60 that is transferred to basket 24. Moment M can be calculated as the x-component of tension $T_x$ (which is equal to the tension T multiplied by the sine of the angle θ) multiplied by the distance H along the y-direction between the application point of tension T (which is generally along flex joint 60 at the lowest point of the bend or curve—represented here at the lower end 60*b*) and the point or region of coupling between the stress joint 60 and basket 24 (i.e., where the portions of surface 60*c* and profile 26 are engaged with one another). In other words, the moment M can be represented by the following expression:

$$M=(H)(T\sin\theta).$$

Depending on the operating conditions (e.g., weight of the riser 50, height of the ocean waves, strength of the ocean current, etc.), the tension T may increase such that the resulting moment M overcomes the strength of basket 24 and/or porch 22, thereby damaging connection assembly 30 by either extreme loading or cyclic overutilization (fatigue). In addition, during operation, the angularity between the riser 50 and platform 20 may also greatly contribute to the magnitude of moment M. Depending on the severity of the damage, the riser 50 may become completely disconnected from platform 20. Simply increasing the load bearing capacity of connection assembly 30 (e.g., basket 24) may not be economically feasible for existing platforms 20 due to the costs of such mechanical modifications to the supporting structure (which may be located under water). Therefore, embodiments disclosed herein are directed to connection assemblies to reduce the bending moments transferred to the basket 24 and porch 22 by the riser 50 and stress joint 60 during such offshore production operations.

Figure 4:
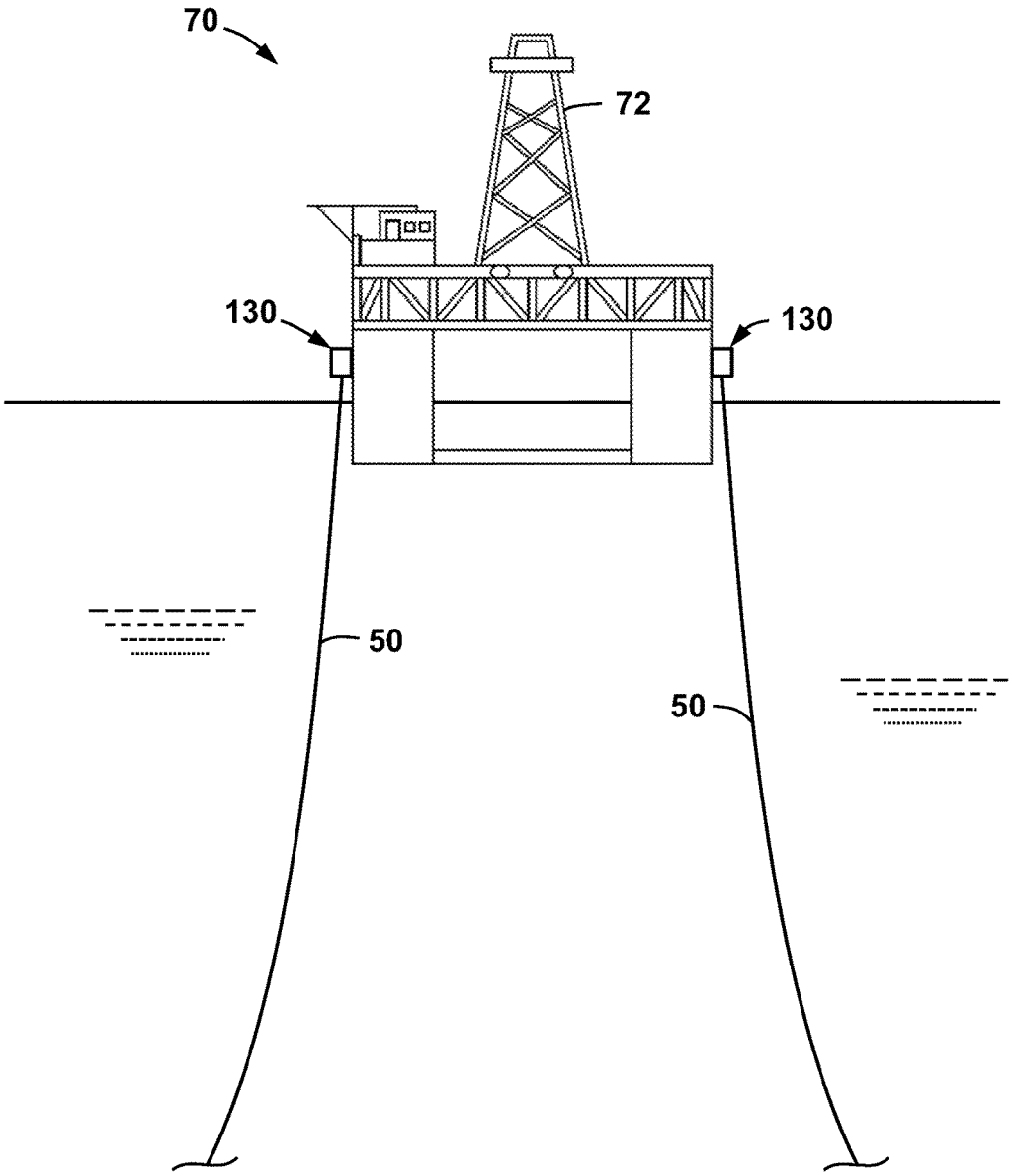
FIG. 4 is a schematic front view of an embodiment of an offshore production system in accordance with the principles described herein.

Referring now to FIG. 4, an embodiment of a system 70 for producing hydrocarbons from a subsea production site (e.g., a well, manifold, etc.) is shown. System 70 generally includes a floating offshore platform 72 and a plurality of risers 50 coupled to platform 72 with connection assemblies 130. In general, platform 72 can be any offshore floating vessel known in the art including, without limitation, a semi-submersible platform, a tension leg platform, a spar platform, etc. In this embodiment, platform 72 is a semi-submersible platform.

Risers 50 extend downward from platform 72 to a production fluid source site (not shown) proximal or at the sea floor. In this embodiment, the risers 50 are steel catenary risers (SCRs), and thus, risers 50 take on a curved shape between platform 72 and the sea floor (not shown). Each riser 50 is coupled to platform 72 with one connection assembly 130. As a result, movements and loads (e.g., tension, torque, etc.) experienced by risers 50 are transferred to platform 72 through the corresponding connection assemblies 130. Conversely, movements and loads experienced by platform 72 are transferred through connection assemblies 130 to risers 50. In general, risers 50 transfer production fluids from the subsea source to platform 72. Thus, during production operations, production fluids are routed from the subsea production site to platform 72 through risers 50.

Figure 5:
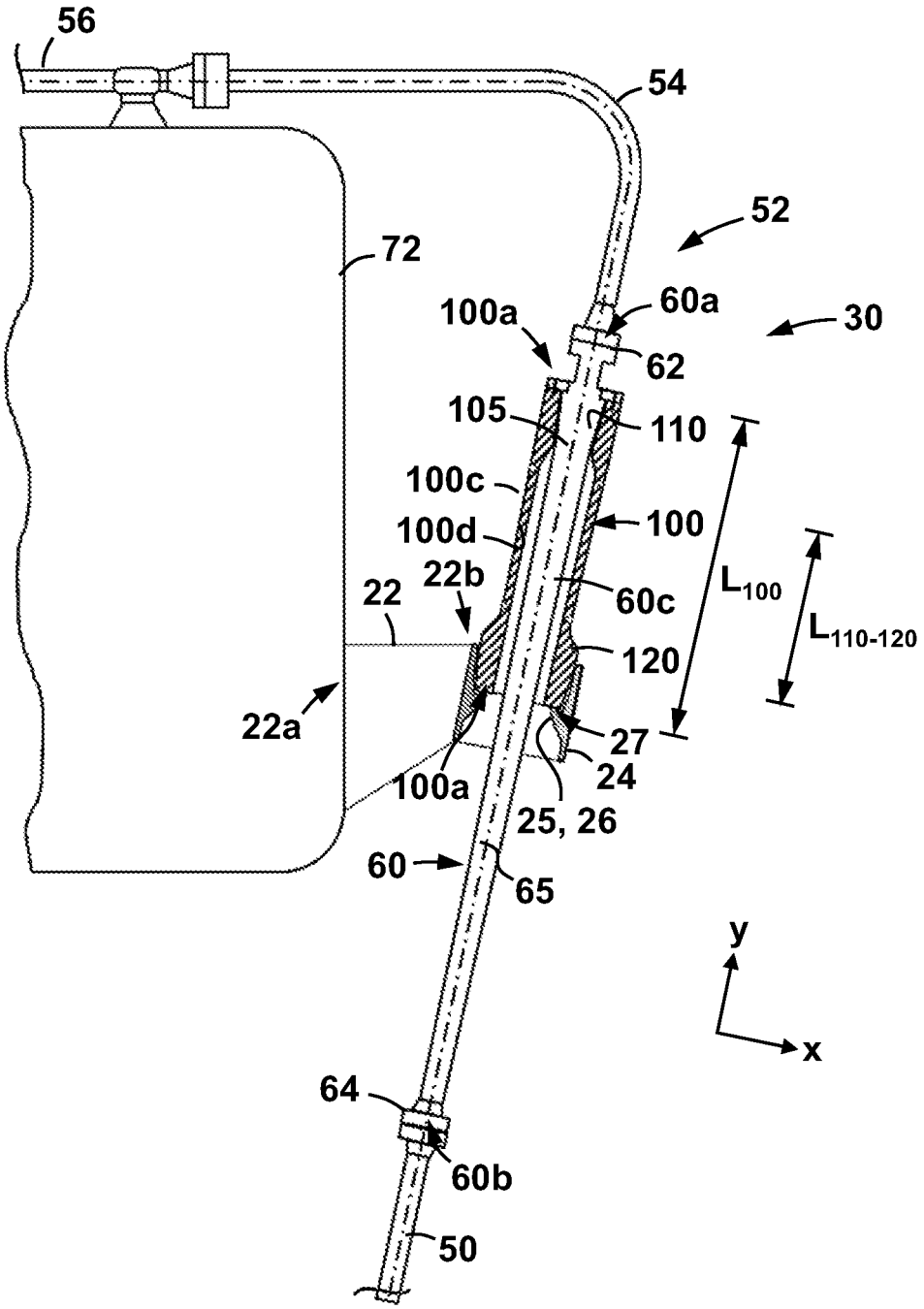
FIG. 5 is a side, partial cross-sectional view of one of the riser connection assemblies for connecting an upper riser assembly of one subsea riser of FIG. 4 to the offshore platform of FIG. 4.

Referring now to FIG. 5, one connection assembly 130 will be described, it being understood that each connection assembly 130 is the same. In this embodiment, connection assembly 130 includes a porch 22 secured to platform 72, a basket 24 attached to porch 22 distal platform 72, and an upper riser assembly 152. Porch 22 and basket 24 are each as previously described.

Upper riser assembly 152 includes a spool 54, a tapered stress joint 60, and an extension member 100. Spool 54 and stress joint 60 are each as previously described. Namely, tapered stress joint 60 includes a central axis 65, a first or upper end 60*a*, a second or lower end 60*b* opposite upper end 60*a*, and a frustoconical radially outer surface 60*c* extending between ends 60*a*, 60*b*. Upper end 60*a* of stress joint 60 is coupled to spool 54 with a first or upper connection flange 62 and lower end 60*b* of stress joint 60 is coupled to riser 50 with a second or lower connection flange 64. Spool 54 extends from upper end 60*a* of stress joint 60 to additional piping 56 on platform 20. In this embodiment, the central axis 65 of joint 60 forms an angle α with the vertical direction. In general, $L_{100}$ angle between 0° and 90°. As shown in FIG. 5, angle α is 12°. Stress joint 60 extends through basket 24, however, in this embodiment, stress joint 60 does not contact or slidingly engage basket 24. In other words, outer surface 60*c* is spaced apart from inner surface 25 and profile 26 of basket 24. More specifically, in this embodiment, extension member 100 is radially positioned between stress joint 60 and basket 24.

Referring still to FIG. 5, extension member 100 is an elongate, hollow tubular member that includes a central, longitudinal axis 105, a first or upper end 100*a*, a second or lower end 100*b* opposite upper end 100*a*, a radially outer surface 100*c* extending axially between ends 100*a*, 100*b*, and a radially inner surface 100*d* extending axially between ends 100*a*, 100*b*. Axis 105 is coaxially aligned with axis 65 at upper ends 100*a*, 60*a* of extension member 100 and stress joint 60, respectively. Radially inner surface 100*d* defines a first or upper mating profile 110 at and proximate upper end 100*a*, and radially outer surface 100*c* defines a second or lower mating profile 120 at and proximate lower end 100*b*. Upper profile 110 mates with and slidingly engages radially outer surface 60*c* of stress joint, and lower profile 120 mates with and slidingly engage profile 26 of basket 24. Specifically, in this embodiment, upper mating profile 110 is frustoconical in shape so that when stress joint 60 is inserted axially within extension member 100, radially outer frustoconical surface 60*c* of stress joint 60 slidingly engages the frustoconical surface of upper mating profile 110 until stress joint 60 is axially fixed and secured within extension member 100 through a friction fit between surface 60*c* and profile 110. In other embodiments, radially outer surface 60*c* of stress joint 60 engages with a load shoulder defined within upper mating profile 110 to thereby secure stress joint 60 within extension member 100. In addition, in this embodiment, lower mating profile 120 is frustoconical in shape so that when extension member 100 is inserted axially within basket 24, profile 120 slidingly engages with profile 26 (which may also include a corresponding frustoconical surface) until lower end 100*b* engages or abuts shoulder 27 thereby securing extension member 100 within basket 24. Also, it should be noted that profile 120 may engage a mating surface of profile 26 with a friction fit to further secure lower end 100*b* of extension member 100 within basket 24.

Extension member 100 includes a total length $L_{100}$ measured axially (relative to axis 105) between ends 100*a*, 100*b*. In some embodiments, length $L_{100}$ ranges from 10 to 20 feet. In this embodiment, length $L_{100}$ is 15 feet. Further, extension member 100 has an extension length $L_{110\text{-}120}$ measured axially (relative to axis 105) between mating profiles 110, 120. Extension length $L_{110\text{-}120}$ represents the minimum distance between the region or point of engagement of upper profile 110 and radially outer surface 60*c* of stress joint 60 and the region or point of engagement of lower profile 120 and profile 26 of basket 24. In embodiments described herein, extension length $L_{110\text{-}120}$ ranges from 5 to 25 ft. In this embodiment, extension length $L_{110\text{-}120}$ is 15 ft.

As will be described in more detail below, extension length $L_{110\text{-}120}$ generally represents the axial displacement of the stress joint 60 from basket 24 as compared to the connection assembly 30 shown in FIGS. 2 and 3. For the reasons explained more fully below, this displacement reduces the length of the moment arm for moments transferred to the basket 24 and porch 22 as a result of tension (e.g., tension T) in the riser 50.

To couple riser 50 to platform 20, lower end 100*b* of extension member 100 is inserted within basket 24 until lower profile 120 slidingly engages mating profile 26 and lower end 100*b* engages or abuts shoulder 27 of basket 24 as previously described. Thereafter, stress joint 60 is inserted axially through extension member 100 until frustoconical outer surface 60*c* of stress joint 60 slidingly engages and is seated on the frustoconical surface of upper profile 110 of extension member 100 as previously described. Upper end 60*a* of stress joint 60 is then coupled to spool 54 at connection flange 62 and lower end 60*b* is coupled to riser 50 at connection flange 64.

Figure 6:
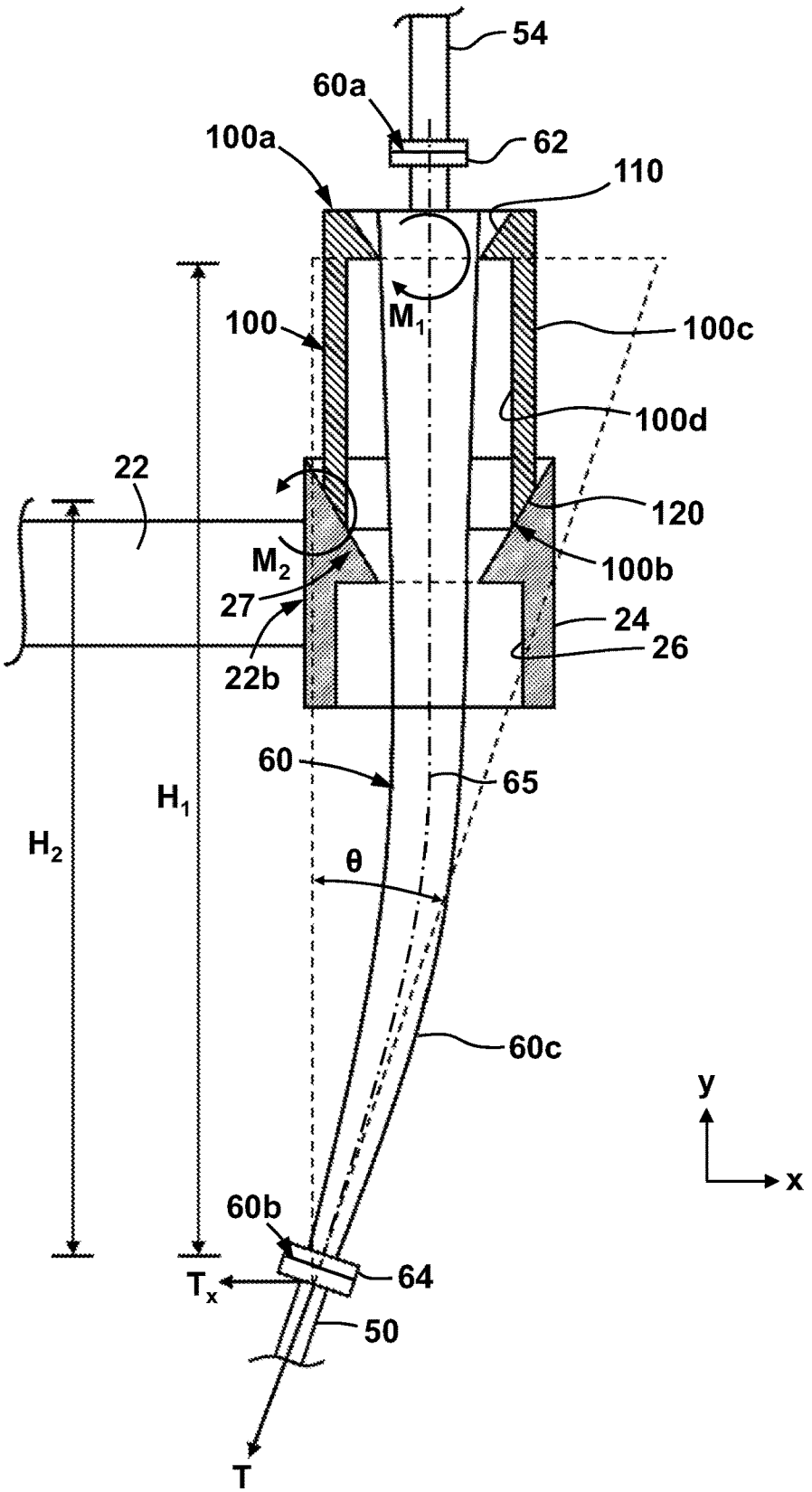
FIG. 6 is a schematic free body diagram of the riser connection assembly, upper riser assembly, and extension member of FIG. 4 illustrating the bending moments resulting from tension in the riser.

Referring now to FIG. 6, during operations, the weight of riser 50 and movements of the platform 72 relative to the sea floor, such as those caused by waves, currents, and/or other phenomena, result in a tension in riser 50 and bending in the stress joint 60. In particular, a tension T is applied along the riser 50 that pulls laterally on stress joint 60, and thereby causes central axis 65 of stress joint 60 to bend or curve at angle θ relative to the y-direction shown in FIG. 6 (note: the y-direction is parallel to the central axis 65 when stress joint 60 is not bent or curved such as shown in FIG. 5). The tension T induces a first moment $M_1$ in extension member 100*a* along connection profile 110 via engagement with stress joint 60, and a second moment $M_2$ is applied to basket 24 along the engaged connection profiles 120, 26. The first moment $M_1$ equals the x-component of tension $T_x$ multiplied by the distance $H_1$ along the y-direction between the application point of tension T and the point (or region) of coupling between surface 60*c* of stress joint 60 and connection profile 110 within extension member 100. In other words, the moment $M_1$ can be represented by the following expression:

$$M_1=(H_1)(T\sin\theta).$$

The height $H_1$ is approximately the same (or at least similar) to the height H shown in FIG. 3. Therefore, the first moment $M_1$ is the same (or at least similar) to the moment M shown in FIG. 3. Accordingly, the loading experienced by basket 24 in the embodiment of FIGS. 2 and 3 is effectively shifted to the upper end 100*a* of extension member 100. Similarly, the second moment $M_2$ is equal to the x-component of the tension $T_x$ multiplied by the distance $H_2$ along the y-direction between the application point of tension T and the point (or region) of coupling between lower connection profile 120 and connection profile 26 within basket 24. In other words, the moment $M_2$ can be represented by the following expression:

$$M_2=(H_2)(T\sin\theta).$$

As is evident from FIG. 5, the height $H_2$ is smaller than the height $H_1$. For example, in some embodiments the difference between the heights $H_2$, $H_1$ may be equal (or similar) to the extension length $L_{110\text{-}120}$ of extension member 100. Therefore, second moment $M_2$ is smaller than first moment Mi. As a result, the moment $M_2$ operating on basket 24 is smaller or reduced as compared to the moments M, M. Thus, by installing extension member 100 between basket 24 and stress joint 60, basket 24 may therefore be coupled to a riser (e.g., riser 50) with a tapered stress joint (e.g., stress joint 60) for more extreme production fluid conditions.

In addition to reducing the bending moment exerted on basket 24 and porch 22, extension member 100 may also provide additional flexibility to upper riser assembly 152 such that the amount or degree of bending of stress joint 60 may be reduced during operations. Such a reduction in the required bending or curvature in stress joint 60 increases the service life of stress joint 60 and allows for the use of smaller and more cost effective stress joints for connecting riser 50 to platform 20. In some embodiments, it is preferable that extension member 100 be ⅕th or less as flexible as stress joint 60 to ensure the desired bending and performance thereof. In addition, in some embodiments, it is preferable that the extension member 100 have a bending stiffness within +/−20% of the bending stiffness of the tapered stress joint 60 proximate upper end 60*a*. Accordingly, in some embodiments, extension member 100 may also include one or more material selection and/or design features that increase the flexibility of extension member 100 about axis 105.

Figure 7:
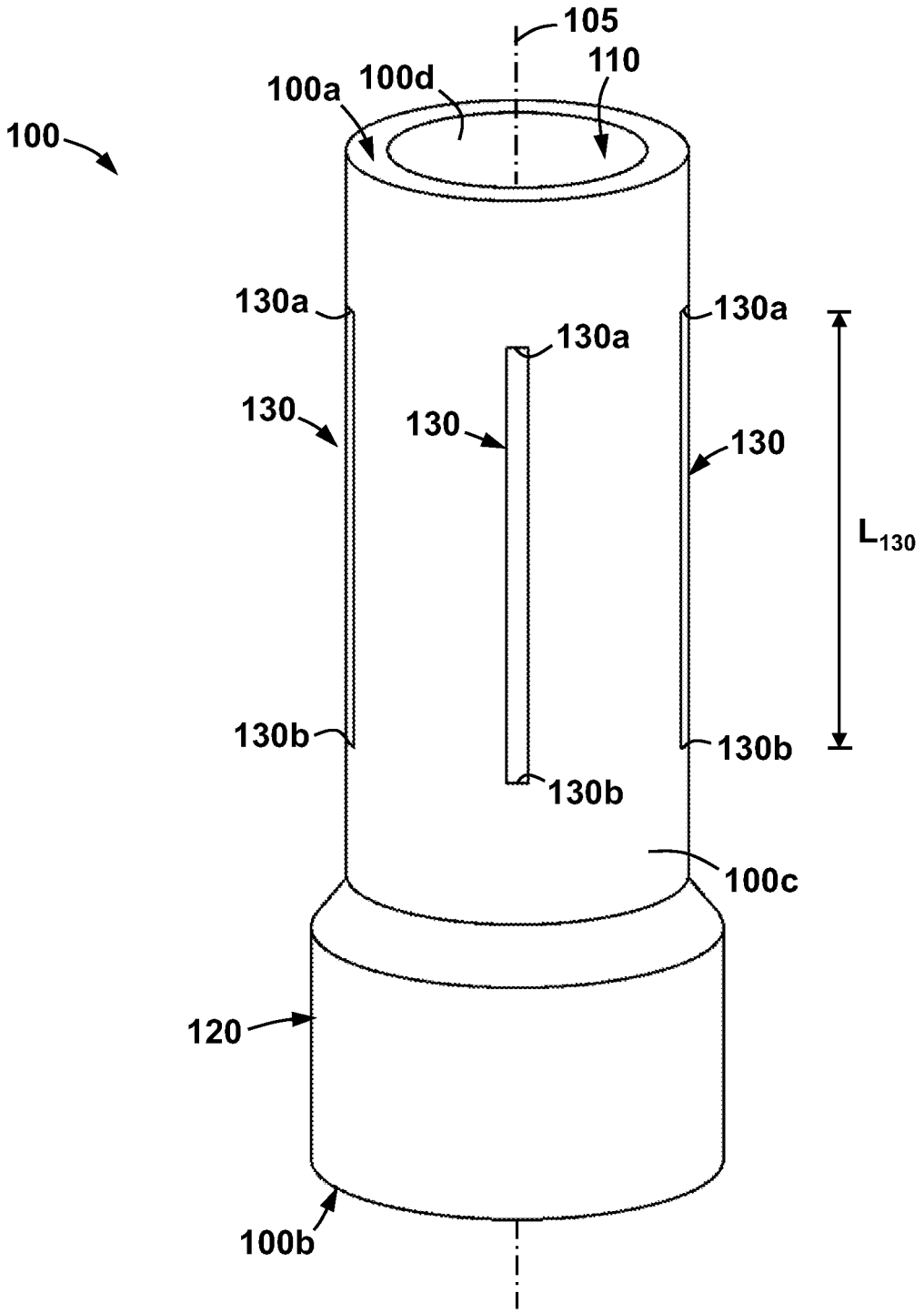
FIG. 7 is a perspective view of the extension member of FIG. 4 including a plurality of axially extending slots.

For example, referring now to FIG. 7, in some embodiments, if less flexibility is required from extension member 100, it may be specified to be manufactured from a steel alloy. Alternatively, if more flexibility is required, it may be specified to be manufactured from a titanium alloy, or, an aluminum alloy.

Also for example, referring now to FIG. 7, in some embodiments, extension member 100 includes a plurality of elongate slots 130 extending radially inward from radially outer surface 100*c*. In this embodiment, slots 130 are rectangular apertures that extend axially along member 100 and each includes a first or upper end 130*a*, a second or lower end 130*b* opposite upper end 130*a*, and an axial length $L_{130}$ extending axially between ends 130*a*, 130*b*. Length $L_{130}$ may range between 3 and 15 ft., and in some embodiments, length may equal 9 ft. In addition, slots 130 extend radially between surfaces 100*c*, 100*d* (i.e., slots 130 may extend completely through the wall of extension member 100).

As shown in FIG. 7, slots 130 are equally angularly spaced along member 100 with respect to axis 105. As a result, in this embodiment, there are a total of four (4) slots 130 that are each spaced 90° from each immediately angularly adjacent slot 130. However, the number and arrangement of slots 130 may be greatly varied in other embodiments (e.g., other embodiments may include three (3) or six (6) equally spaced slots 130). Also, as is also shown in FIG. 6, in this embodiment, slots 130 are disposed in a region of extension member 100 that extends axially between mating profiles 110, 120 previously described.

Without being limited to this or any other theory, slots 130 effectively reduce the amount of material making up extension member 100 (particularly the second moment area) such that extension member 100 is more flexible about central axis 105. In other words, slots 130 allow extension member 100 to more easily bend or flex relative to axis 105 such that extension member 100 may reduce the amount of bending or flexing that is required of stress joint 60 during operations (e.g., as a result of tension T).

While the embodiment of FIG. 7 shows the slots 130 extending axially, it should be appreciated that slots 130 may extend in various other directions in other embodiments. For example, in some embodiments, slots may extend circumferentially or angularly, and in still other embodiments, slots 130 may extend helically. In addition, while slots 130 have been shown and described as being rectangular in shape, it should be appreciated that in other embodiments, slots 130 may be formed in various other shapes. For example, in some embodiments, slots 130 may be elliptical, polygonal, triangular, etc. Also, regardless of the shape of slots 130, each slot 130 may include fillets and/or radiused surfaces to avoid the formation of stress concentrations and to avoid the manufacturing expense of recessed corners. Further, while slots 130 have been shown and described as extending with in a region of extension member 100 that extends axially between mating profiles 110, 120, in other embodiments, slots 130 may extend in other or additional regions of extension member 100. Still further, while slots 130 have been described as extending between surfaces 100*a*, 100*b*, in other embodiments slots 130 may only extend partially between surfaces 100*c*, 100*d*, such that slots 130 do not extend completely radially through the wall of extension member 100 and therefore represent a decrease in the wall thickness of member 100.

Figure 8:
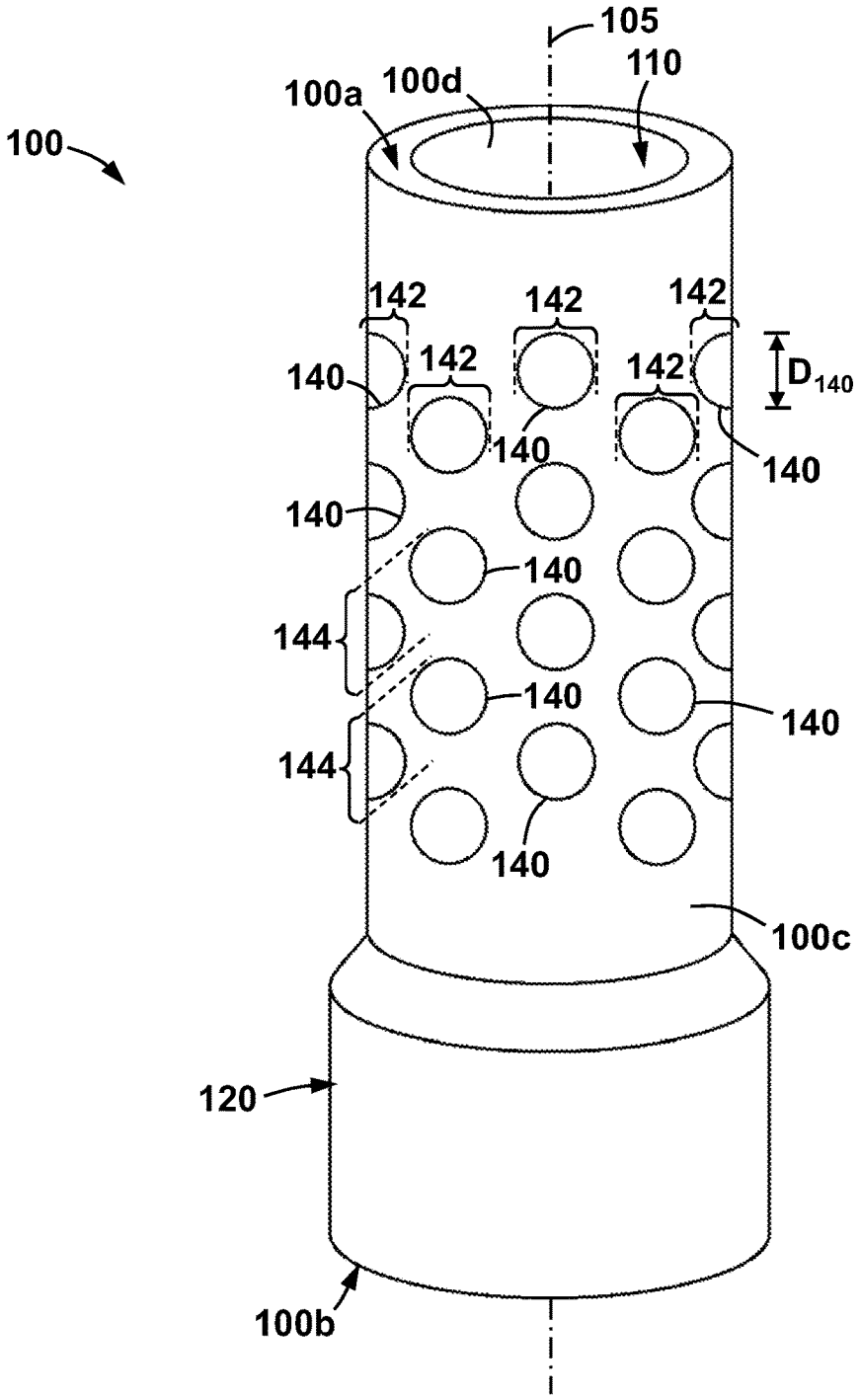
FIG. 8 is a perspective view of the extension member of FIG. 4 including a plurality of apertures.

Referring now to FIG. 8, in some embodiments, extension member 100 includes a plurality of apertures 140 extending radially inward from radially outer surface 100*c*. Specifically, in this embodiment, extension member 100 includes a plurality of columns 142 that each have a plurality of axially spaced apertures 140. Each of the columns 142 are equally, angularly spaced about extension member 100 with respect to axis 105. In addition, in this embodiment, each of the columns 142 includes a total of four (4) apertures 140 that are axially spaced from one another, with each column 142 being alternatively axially offset from each immediately angularly adjacent column 142. As a result, in this embodiment, apertures 140 are also arranged in a plurality of helically extending rows 144 that extend helically about extension member 100 with respect to axis 105. Apertures 140 are also all disposed within a region of extension member 100 extending axially between mating profiles 110, 120.

Each aperture 140 is circular in shape and extends between surfaces 100*c*, 100*d* of extension member 100 (i.e., apertures 140 extend completely through the wall of extension member 100). In addition, in this embodiment, each aperture 140 includes a maximum inner diameter $D_{140}$ that may range from ⅛ to 3 in., and preferably equals ½ in.

Without being limited to this or any other theory, apertures 140 effectively reduce the amount of material making up extension member 100 such that extension member 100 is more flexible about central axis 105. In other words, apertures 140 allow extension member 100 to bend or flex relative to axis 105 such that extension member 100 may reduce the amount of bending or flexing that is required of stress joint 60 during operations (e.g., as a result of tension T).

While apertures 140 have been shown and described as being circular in shape, it should be appreciated that in other embodiments, apertures 140 may be formed in various other shapes. For example, in some embodiments, apertures 140 may be elliptical, rectangular, square, polygonal, triangular, etc. Also, regardless of the shape of apertures 140, each aperture 140 may include fillets and/or radiused surfaces to avoid the formation of stress concentrations and to avoid the manufacturing expense of recessed corners. In addition, while apertures 140 have been shown and described as extending with in a region of extension member 100 that extends axially between mating profiles 110, 120, in other embodiments, apertures 140 may extend in other or additional regions of extension member 100. Further, while apertures 140 have been shown and described as being disposed in axially extending columns 142 and helically extending rows 144, it should be appreciated that the number and arrangement of apertures 140 may be greatly varied in other embodiments. For example, in some embodiments, apertures 140 may be disposed in a plurality of axially extending columns and circumferentially extending rows (i.e., adjacent axial columns are not axially offset from one another as shown in FIG. 7). Also, while apertures 140 have been described as extending between surfaces 100*a*, 100*b*, in other embodiments apertures 140 may only extend partially between surfaces 100*c*, 100*d*, such that apertures 140 do not extend completely radially through the wall of extension member 100 and therefore represent a decrease in the wall thickness of member 100.

Figure 9:
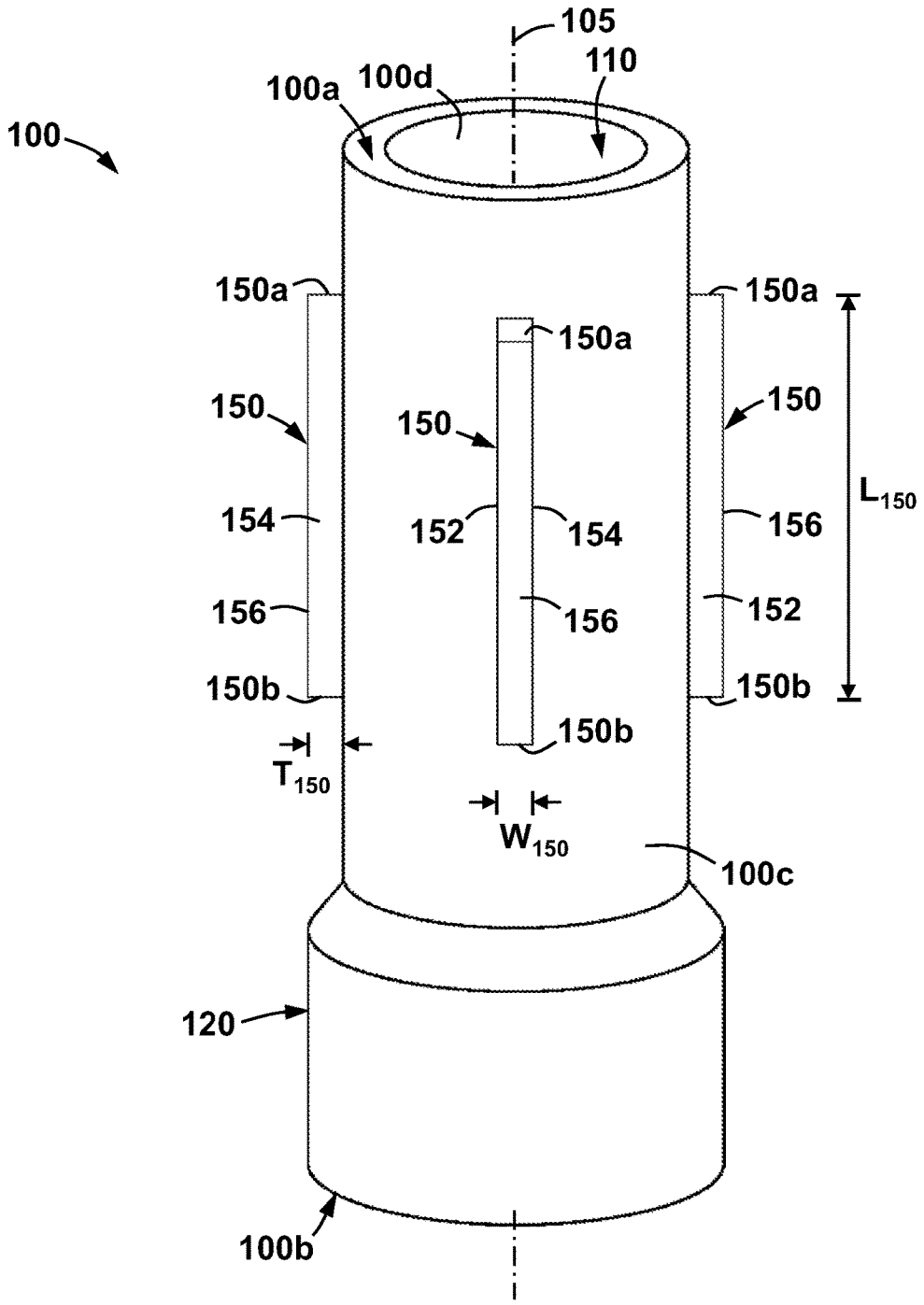
FIG. 9 is a perspective view of the extension member of FIG. 4 including plurality of stiffening ribs.

Referring now to FIG. 9, in some embodiments, extension member 100 includes a plurality of stiffening ribs 150 extending radially outward from radially outer surface 100*c*. In this embodiment, ribs 150 are rectangular projections that extend axially along member 100 and each includes a first or upper end 150*a*, a second or lower end 150*b* opposite upper end 150*a*, a first side 152 extending axially between ends 150*a*, 150*b*, a second side 154 also extending axially between ends 150*a*, 150*b*, and a radially outermost surface 156 also extending axially between ends 150*a*, 150*b*. In addition, each rib 150 includes and an axial length $L_{150}$ extending axially between ends 150*a*, 150*b*, a radial thickness $T_{150}$ extending between the radially outer surface 100*c* and radially outermost surface 156 of rib 150, and a circumferential width (or arc width) $W_{150}$ extending circumferentially between sides 152, 154. Length $L_{150}$ may range between 3 and 15 ft., and in some embodiments, length may equal 9 ft. Thickness $T_{150}$ may range between ½ and 4 in, and width $W_{150}$ may range from ½ to 8 in.

As shown in FIG. 9, ribs 150 are equally angularly spaced along member 100 with respect to axis 105. As a result, in this embodiment, there are a total of four (4) ribs 150 that are each spaced 90° from each immediately angularly adjacent rib 150. However, the number and arrangement of ribs 150 may be greatly varied in other embodiments (e.g., other embodiments may include three (3) or six (6) equally spaced ribs 150). Also, as is shown in FIG. 9, in this embodiment, ribs 150 are disposed in a region of extension member 100 that extends axially between mating profiles 110, 120 previously described. However, in other embodiments, ribs 150 may extend along substantially the entire length of extension member 100 (i.e., from end 100*a* to end 100*b*). In addition in other embodiments, ribs 150 may be disposed more proximate one of the ends 100*a*, 100*b* and may not extend along the entire axial length of member 100. Further, in still other embodiments, extension member 100 may include two sets or ribs 150, with a first set of ribs 150 being circumferentially disposed about extension member 100 at end 100*a*, and a second set of the ribs 150 being circumferentially disposed about extension member 100 at end 100*b*. In at least some of these embodiments, the region of extension member 100 that extends axially between mating profiles 110, 120 is substantially free of ribs 150.

Without being limited to this or any other theory, ribs 150 provide additional structural support and rigidity to extension member 100 such that the wall thickness of extension member 100 between ribs 150 (e.g., the radial distance between surfaces 100*c*, 100*d*) can be reduced to thereby result in a desired amount of flexibility of extension member 100 relative to axis 105. In other words, the reduced wall thickness of extension member 100 between ribs 150 allows extension member 100 to bend or flex relative to axis 105 such that extension member 100 may reduce the amount of bending or flexing that is required of stress joint 60 during operations (e.g., as a result of tension T).

In some embodiments, the thickness $T_{150}$ and width $W_{150}$ of each rib 150 may taper along length $L_{150}$ between ends 150*a*, 150*b*. For example, in some embodiments, the thickness $T_{150}$ and/or width $W_{150}$ of each rib 150 may taper from larger values at one end (e.g., end 150*a* or end 150*b*) to smaller values at the other end (e.g., end 150*b* or end 150*a*). The tapering of thickness $T_{150}$ and/or width $W_{150}$ may be gradual (e.g., linear) or thickness $T_{150}$ and/or width $W_{150}$ may include one or more step changes between ends 150*a*, 150*b*. In addition, while ribs 150 are shown and described herein as being rectangular shaped projections, it should be appreciated that ribs 150 may be formed in a wide variety of shapes (e.g., elliptical, triangular, etc.).

Figure 10:
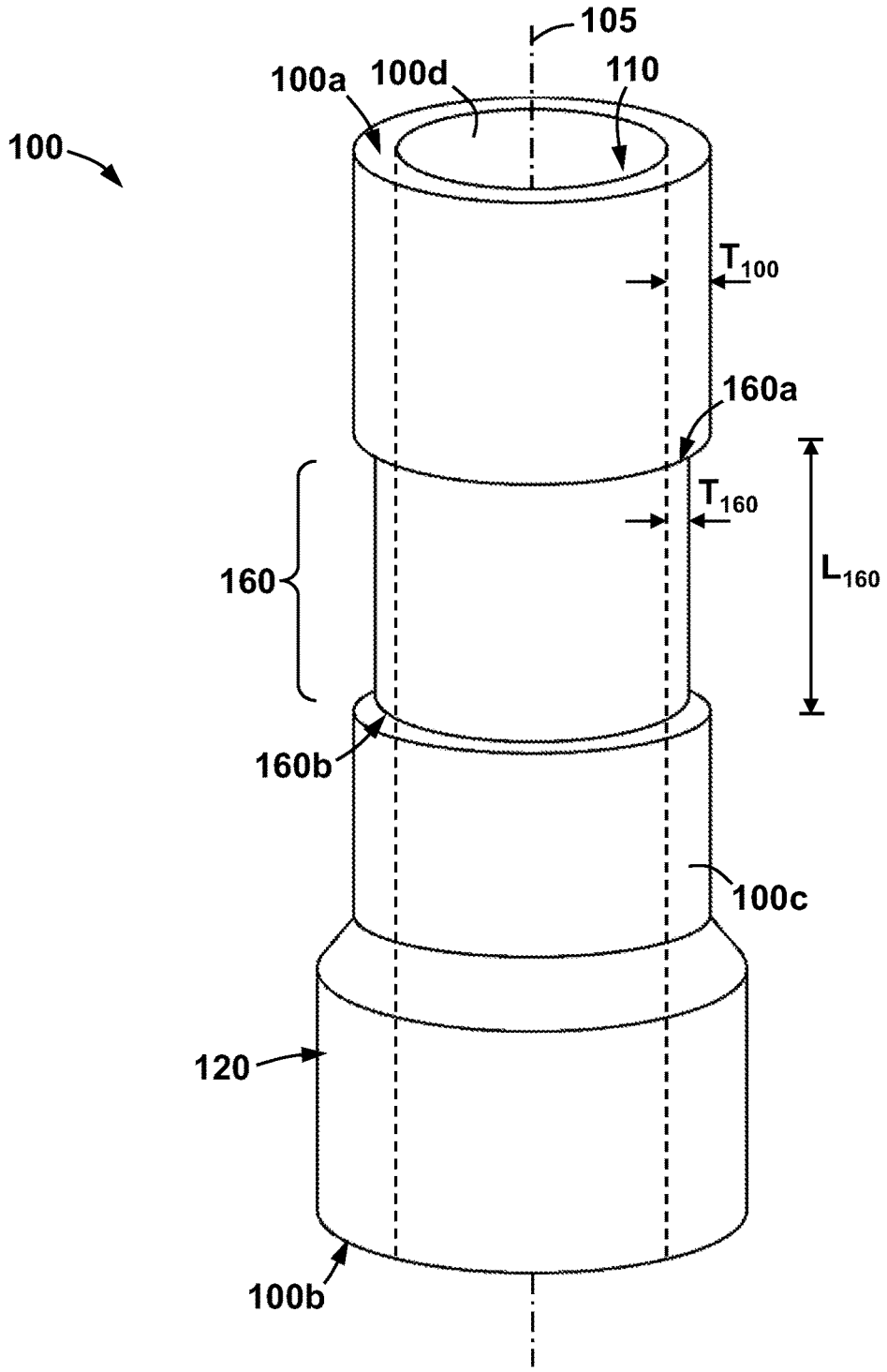
FIG. 10 is a perspective view of the extension member of FIG. 4 including a reduced thickness region.

Referring now to FIG. 10, in some embodiments, extension member 100 includes a reduced thickness region 160 extending axially along outer surface 100*c* between mating profiles 110, 120. Region 160 includes a first or upper end 160*a*, a second or lower end 160*b* opposite upper end 160*a*, and a radially outer surface 160*c* extending axially between ends 160*a*, 160*b*. In addition, region includes an axial length $L_{160}$ extending axially between ends 160*a*, 160*b*. Length $L_{160}$ may range between 1 and 20 ft., and in some embodiments may equal 5 ft. Further, region 160 has a wall thickness $T_{160}$ extending radially between radially inner surface 100*d* of extension member 100 and radially outer surface 160*c*. Radially outer surface 160*c* of region 160 is radially inset from the rest of radially outer surface 100*c* of extension member 100, and thus wall thickness $T_{160}$ of region is less than a wall thickness $T_{100}$ (which is the radial distance between surfaces 100*c*, 100*d* outside of region 160) of extension member 100. Wall thickness $T_{160}$ is between 1% and 50% smaller than wall thickness $T_{100}$, and in some embodiments, wall thickness $T_{160}$ is 20% smaller than wall thickness $T_{100}$.

Without being limited to this or any other theory, the reduced wall thickness (e.g., thickness $T_{160}$) of region 160 increases the flexibility of extension member 100 about central axis 105. In other words, region 160 allows extension member 100 to bend or flex relative to axis 105 such that extension member 100 may reduce the amount of bending or flexing that is required of stress joint 60 during operations (e.g., as a result of tension T).

While only a single region 160 is shown in the embodiment of FIG. 9, it should be appreciated that other embodiments may include a plurality of axially spaced reduced thickness regions (e.g., region 160). In addition, while the reduced wall thickness $T_{160}$ of region is accomplished through a radially inset outer surface 160*c*, it should be appreciated that other embodiments may include a radially expanded inner surface along region 160 to accomplish the reduced wall thickness. Further, in some embodiments, any two or more of the flexibility increasing design features shown in FIGS. 7-10 (i.e., slots 130, apertures 140, rubs 150, reduced thickness sections 160, etc.) may be utilized together on extension member 100.

In addition to the particular embodiment of the extension member shown in FIG. 5, other alternative embodiments may be used with different mating profiles. For example, it is not necessary for upper mating profile 110 to be frustoconical in shape. The important function of this feature is to generate friction between surface 60*c* of stress joint 60 and upper mating profile 110, sufficient to ensure that stress joint 60 is axially fixed within extension member 100. Thus, upper mating profile 110 could have a surface that is stepped or curvilinear or any other shape, as long as the inner diameter at the top end of the upper mating profile is larger than the inner diameter at the bottom end of the upper mating profile.

Similarly, it is not necessary for lower mating profile 120 to be frustoconical in shape. The important function of this feature is to provide a lower end 100*b* that engages or abuts shoulder 27, thereby securing extension member 100 within basket 24. In addition, lower mating profile 120 may generate friction between profile 26 and lower mating profile 120, to further secure lower end 100*b* of extension member 100 within basket 24. In order to accomplish that, however, it is not necessary for lower mating profile to be frustoconical in shape. Thus, to achieve the optional purpose of generating such friction, lower mating profile 110 could have a surface that is stepped or curvilinear or any other shape, as long as the outer diameter at the top end of the lower mating profile is larger than the outer diameter at the bottom end of the lower mating profile.

In the manner described, by coupling a stress joint (e.g., stress joint 60) to a basket (e.g., basket 24) of an offshore platform (e.g., platform 20) with an extension member in accordance with the embodiments disclosed herein (e.g., extension member 100), the bending moment experienced by the basket and adjacent support structures (e.g., porch 22) as a result of tension in the riser may be reduced. As a result, the basket may be utilized with a metallic tapered stress joint even when higher bending loads (e.g., caused by environmental conditions) are expected. In addition, through use of an extension member in accordance with the embodiments disclosed herein, the amount of bending typically experienced by the stress joint may be reduced due to the additional bending of the extension member during operations. As a result, the life of the stress joint may be increased and the operating requirements for the stress joint may be reduced.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, in some embodiments, the slots 130 may be tapered such that each slot 130 is wider at one end (e.g., an upper end) and narrower at an opposite end (e.g., a lower end). As another embodiment, in some embodiments, the wall thickness of extension member 100 may be tapered between the ends 100*a*, 100*b*.

Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An extension member for coupling a tapered stress joint to a basket coupled to a porch extending from an offshore platform, the extension member comprising:

a generally cylindrical body, said body comprising:

a central axis;

a first end;

a second end opposite the first end;

a radially inner surface extending axially from the first end to the second end, wherein the inner surface is configured to slidingly engage a tapered stress joint and comprises a first mating profile proximate the first end, said mating profile comprising a portion of said radially inner surface such that the mating profile comprises a top end with a first inner diameter and a bottom end with a second inner diameter, with the first inner diameter being greater than the second inner diameter; and a radially outer surface extending axially from the first end to the second end, wherein the outer surface is configured to slidingly engage a basket coupled to a porch extending from an offshore platform and comprises a second mating profile proximate the second end; and wherein said body is configured such that said tapered stress joint does not directly engage said basket.

2. The extension member of claim 1, further comprising an aperture extending radially between the radially outer surface and the radially inner surface.

3. The extension member of claim 2, wherein the aperture comprises an axially extending slot.

4. The extension member of claim 3, wherein the slot is rectangular in shape.

5. The extension member of claim 2, wherein the aperture comprises a circular aperture.

6. The extension member of claim 1, further comprising a stiffening rib extending axially along the radially outer surface, and extending radially outward from the radially outer surface.

7. The extension member of claim 1, further comprising a reduced thickness region disposed axially between the first mating profile and the second mating profile, wherein the reduced thickness region includes a wall thickness that is smaller than a wall thickness of the extension member adjacent to the reduced thickness region.

8. The extension member of claim 1, wherein the first mating profile is frustoconical.

9. The extension member of claim 1, wherein the second mating profile is frustoconical.

10. The extension member of claim 1, wherein the body is formed of a steel alloy.

11. The extension member of claim 1, wherein the body is formed of a titanium alloy.

12. The extension member of claim 1, wherein the body is formed of an aluminum alloy.

13. A system for supporting a riser from an offshore platform, the system comprising:

a basket configured to be coupled to the offshore platform;

a tapered stress joint coupled to the riser, the tapered stress joint including a central axis, a first end, a second end opposite the first end, and a radially outer surface that tapers radially inward from the first end toward the second end;

an extension member coupled to each of the basket and the tapered stress joint, wherein the extension member includes a first end, a second end opposite the first end;

wherein the extension member comprises a first mating profile that slidingly engages the tapered stress joint proximate the first end of the extension member;

wherein the extension member comprises a second mating profile that slidingly engages the basket proximate the second end of the extension member; and wherein said extension member is configured such that said tapered stress joint does not directly engage said basket.

14. The system of claim 13, wherein the extension member includes a first mating profile proximate the first end of the extension member and a second mating profile proximate the second end of the extension member;

wherein the first mating profile is engaged with the radially outer surface of the tapered stress joint; and wherein the second mating profile is engaged with the basket.

15. The system of 14, wherein the extension member includes a radially outer surface extending between the first end and the second end of the extension member;

wherein the extension member includes a radially inner surface extending between the first end and the second end of the extension member;

wherein the first mating profile is disposed along the radially inner surface of the extension member; and wherein the second mating profile is disposed along the radially outer surface of the extension member.

16. The system of claim 15, wherein the extension member further comprises an aperture extending radially between the radially outer surface and the radially inner surface.

17. The system of claim 16, wherein the aperture comprises an axially extending slot.

18. The system of claim 17, wherein the slot is rectangular in shape.

19. The system of claim 16, wherein the aperture comprises a circular aperture.

20. The system of claim 13, wherein the extension member further comprises a stiffening rib extending axially along the radially outer surface, and extending radially outward from the radially outer surface.

21. The system of claim 13, wherein the extension member further comprises a reduced thickness region disposed axially between the first mating profile and the second mating profile, wherein the reduced thickness region includes a wall thickness that is smaller than a wall thickness of the extension member adjacent to the reduced thickness region.

22. The system of claim 13, wherein the extension member is formed of a steel alloy.

23. The system, of claim 13, wherein the extension member is formed of a titanium alloy.

24. The system of claim 13, wherein the extension member is formed of an aluminum alloy.

25. A system for supporting a riser from an offshore platform, the system comprising:

a connection assembly coupled to the offshore platform;

a tapered stress joint coupled to the riser;

an extension member configured to slidingly engage each of the connection assembly and tapered stress joint, wherein the extension member is a hollow tubular member that includes:

a central axis;

a first end;

a second end opposite the first end;

a radially inner surface comprising a first mating profile extending axially between the first end and the second end; and a radially outer surface comprising a second mating profile extending axially between the first end and the second end;

wherein the extension member is configured to slidingly engage the connection assembly along the second mating profile proximate the second end; and wherein the extension member is configured to slidingly engage the tapered stress joint along the first mating profile proximate the first end; and wherein said extension member is configured such that said tapered stress joint does not directly engage said connection assembly.

26. The system of claim 25, further comprising an aperture extending radially between the radially outer surface and the radially inner surface.

27. The system of claim 26 wherein the aperture comprises one of an axially extending slot and a circular aperture.

28. The system of claim 25, wherein the extension member is formed of a steel alloy.

29. The system, of claim 25, wherein the extension member is formed of a titanium alloy.

30. The system of claim 25, wherein the extension member is formed of an aluminum alloy.

* * * * *